United States Patent [19]

Hahn

[11] Patent Number: 4,790,773

[45] Date of Patent: Dec. 13, 1988

[54] ELECTRICAL RECEPTACLE

[75] Inventor: Marlyn E. Hahn, York, Pa.

[73] Assignee: E. I. Du Pont de Nemours and Company, Wilmington, Del.

[21] Appl. No.: 43,821

[22] Filed: Apr. 29, 1987

Related U.S. Application Data

[63] Continuation-in-part of Ser. No. 908,341, Sep. 17, 1986, abandoned.

[51] Int. Cl.[4] ..... H01R 13/26

[52] U.S. Cl. ..... 439/474; 439/682

[58] Field of Search ..... 439/839, 842, 845, 846, 439/847, 850, 851, 852, 856, 823, 834, 840, 682, 685, 691, 474

[56] References Cited

U.S. PATENT DOCUMENTS

| | | | |
|---|---|---|---|
| 2,666,189 | 1/1954 | Cook | 339/192 |
| 2,691,147 | 10/1954 | Sutton et al. | 339/192 |
| 3,047,832 | 7/1962 | Deakin | 339/217 |
| 3,286,220 | 11/1966 | Marley et al. | 339/192 |
| 3,447,121 | 5/1969 | Ammermau et al. | 339/192 |
| 3,764,960 | 10/1973 | Heimbrock | 339/217 S |
| 3,803,537 | 4/1974 | Cobaugh et al. | 339/256 |
| 3,865,455 | 2/1975 | Berg et al. | 339/17 |
| 4,342,498 | 8/1982 | Patton et al. | 339/256 |
| 4,534,610 | 8/1985 | Takihara | 439/839 |
| 4,660,920 | 4/1987 | Shibano | 439/724 |

FOREIGN PATENT DOCUMENTS

| | | | |
|---|---|---|---|
| 2057313 | 3/1972 | Fed. Rep. of Germany | 439/852 |
| 2057313 | 5/1972 | Fed. Rep. of Germany . | |
| 832970 | 4/1960 | United Kingdom | 439/192 |
| 0879968 | 11/1961 | United Kingdom | 439/682 |

*Primary Examiner*—John McQuade

[57] ABSTRACT

An electrical receptacle having a spring contact contained therein. The spring is formed with a nonflexing portion which provides a stiff section that acts as a positive stop to prevent overstressing the spring and permanently deforming it.

3 Claims, 6 Drawing Sheets

ELECTRICAL RECEPTACLE

CROSS REFERENCE TO RELATED APPLICATION

This application is a continuation-in-part of application Ser. No. 908,341; filed Sept. 17, 1986 and now abandoned.

BACKGROUND OF THE INVENTION

This invention relates to electrical receptacles. More particularly, it relates to improved electrical receptacles having spring means contained therein.

Electrical receptacles, or sockets as they are sometimes referred to, are essential elements of electrical connectors. Normally, one end of the socket terminates a cable conductor by using solder or some other technique. The other end is open and is adapted to receive a corresponding electrical pin contact. Then a spring is fixed in the box to provide spring force on the pin to make contact therewith. A solder tab is part of the spring.

SUMMARY OF THE INVENTION

This invention is based on the objective of providing a plug-in receptacle of the type described above that prevents overstressing of the contact spring which is in the general form of a leaf spring having a central arc portion when an associated contact pin is inserted skewed and as a result permanently deforms the spring. This objective is achieved by providing either a hump in the passage of the receptacle housing below the spring or a tapered groove in the passage to serve as an overstress stop for the spring when it is flexed by the pin. In preferred embodiments, the spring itself incorporates the overstress stop by being formed with a double bend nonflexing portion; i.e., a hump, in the arc portion of the leaf spring, preferably near the apex of the arc, or by forming a concave non-flexing depression near the apex of the arc.

DETAILED DESCRIPTION OF THE ILLUSTRATED EMBODIMENTS

Figure 1:
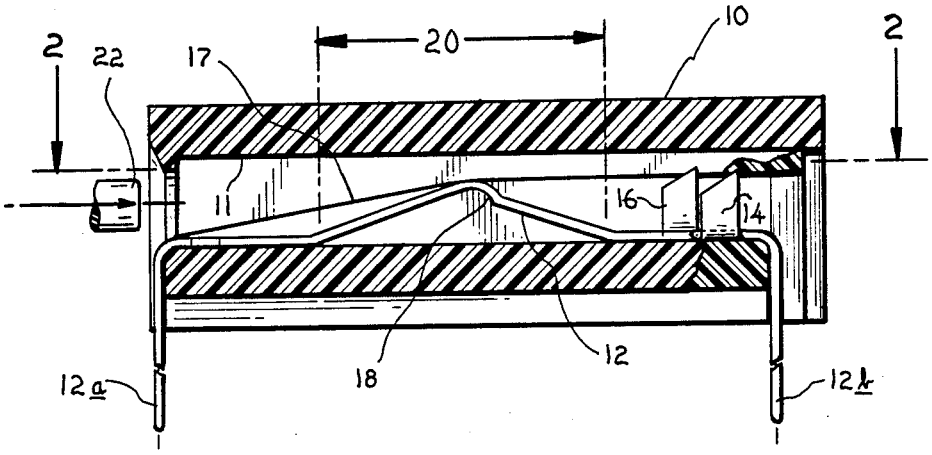
FIG. 1 is a cross-sectioned side elevation of the receptacle of this invention.
Figure 2:
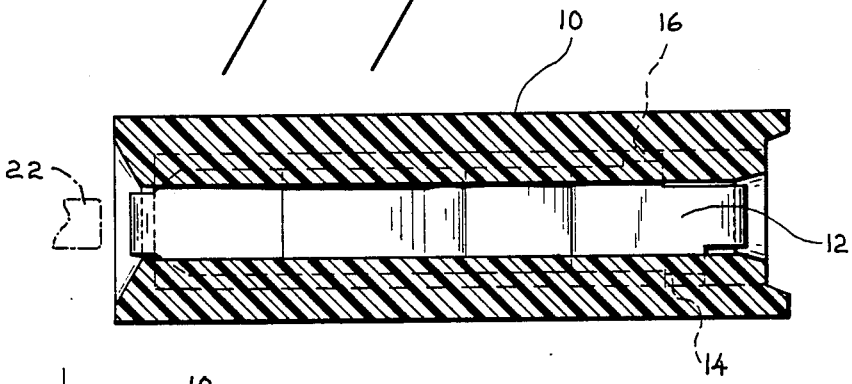
FIG. 2 is a cross-sectioned view of FIG. 1 taken along line 2—2.
Figure 3:
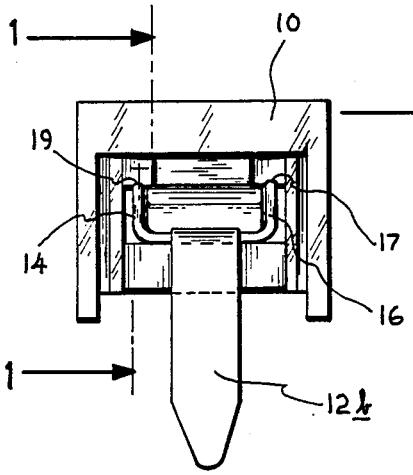
FIG. 3 is an end view of FIG. 1.
Figure 1A:
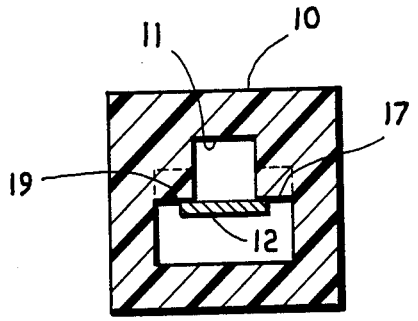
FIGS. 1A and 1B are cross-section views of FIG. 1 taken along lines 1A—1A and 1B—1B respectively.
Figure 1B:
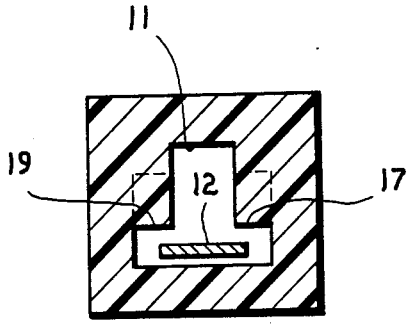

Referring now to FIGS. 1–3, the receptacle chosen for purposes of illustration for this embodiment of the invention includes as its basic elements a housing 10 made of insulating plastic material. Received in the through passage 11 of the housing is a resilient metal leaf spring member 12. Tabs 14 and 16 are formed at one end of spring 12 and bent at a 90° angle so that in connection with the interior of the housing in the form of inclined plane sections 17,19, against which the edges of spring 12 rest a secure fastening for the spring in the housing is obtained. The inclined plane sections 17, 19 engage the edges of spring 12 and serve to preload spring 12 to reduce the insertion force of pin 22 and also serve as a guide for centering pin 22. The spring 12 also has legs 12*a*, 12*b* formed at either end to provide for a solder connection at each end of the connector. A double-bend nonflexing portion of hump 18 is formed in the arc portion 20 of the spring to provide a section that acts as a positive stop should the spring be overstressed by skewed insertion of pin 22 and assures that spring 12 can only be elastically deformed but not permanently deformed; more particularly, the double bend portion 18 presents a flat length portion that will bottom in the housing if hit with a skewed pin. The consequent resistance to flexing deflects the pin upwardly to its proper location before permanent deformation of the spring occurs.

Figure 4:
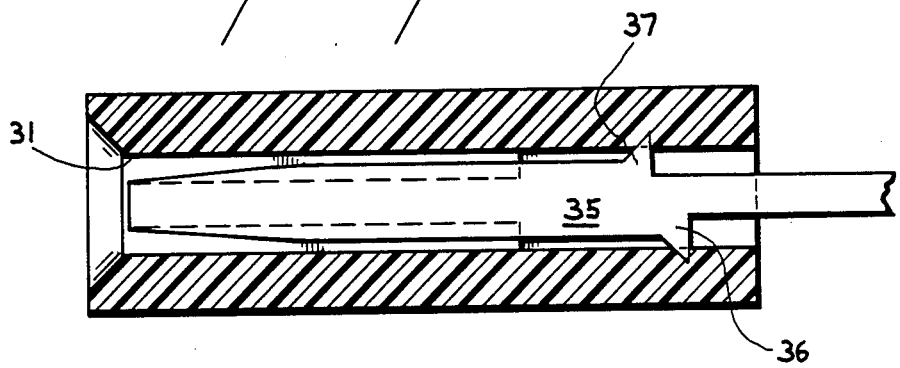
FIG. 4 is a cross-sectional view of FIG. 5 taken along the line 4—4.
Figure 5:
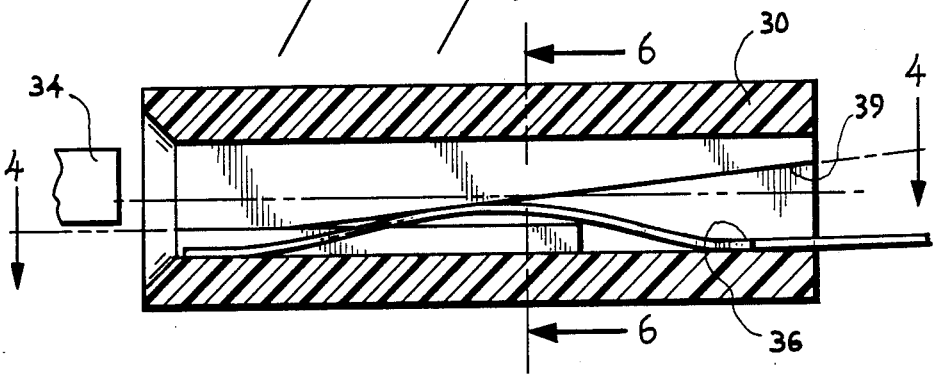
FIG. 5 is a cross-sectional side view of another embodiment of the receptacle of this invention.
Figure 6:
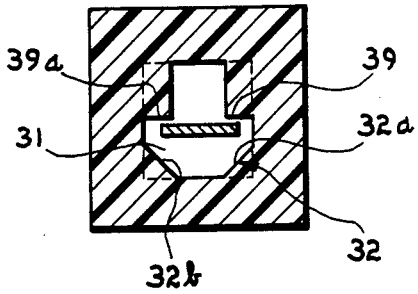
FIG. 6 is a cross-sectional view of FIG. 5 taken along line 6—6.
Figure 6A:
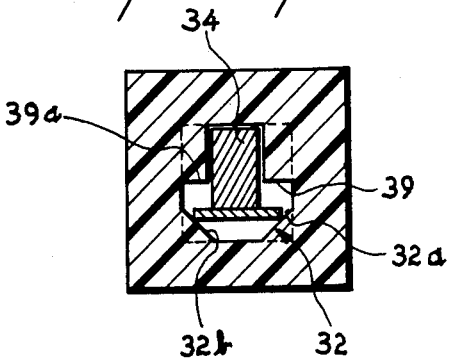
FIG. 6*a* is a cross-sectional view of FIG. 5 taken along line 6—6 with pin 34 inserted into the receptacle.

In another embodiment shown in FIGS. 4–6, the through passage 31 of the housing 30 has a tapered groove 32 formed in the base of passage 31 adjacent to the end of the receptacle for receiving pin 34. The groove 32 extends partially through the passage 31 and allows spring 35 which is staked in the receptacle by tabs 36 and 37 and held by flexing against inclined planes 39, 39*a* to flex under the influence of pin 34 until the spring rests on tapered walls 32*a*, 32*b* of groove 32.

Figure 7:
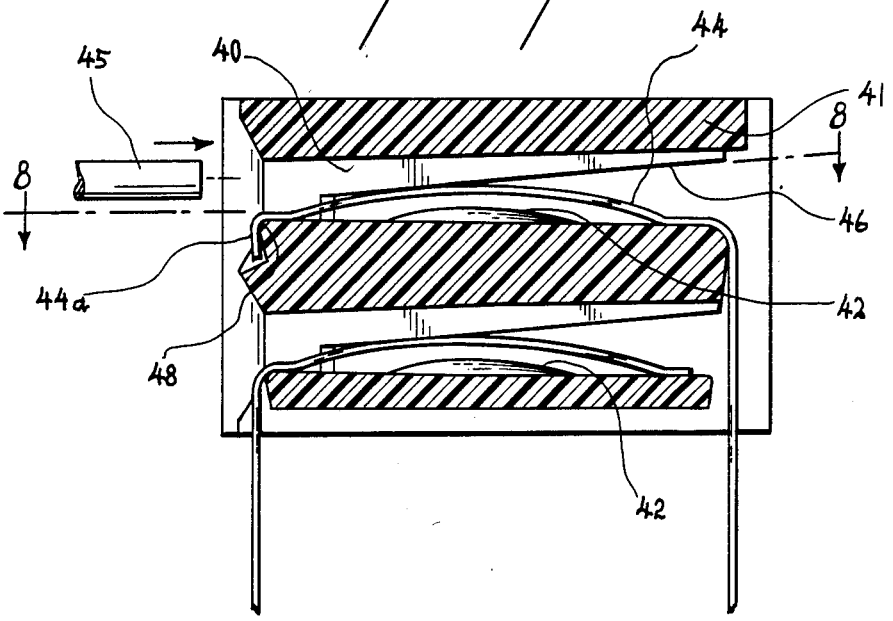
FIG. 7 is a cross-sectioned side view of still another embodiment of the receptacle of this invention.
Figure 8:
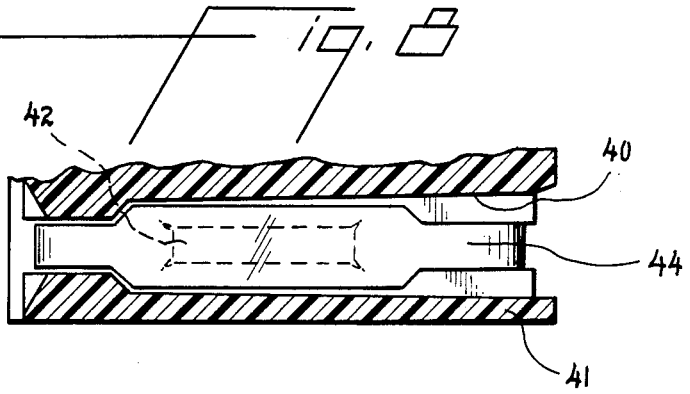
FIG. 8 is a cross-sectioned view of FIG. 7 taken along line 8—8.

In yet another embodiment shown in FIGS. 7 and 8 the through passage 40 of housing 41 incorporates a raised hump 42 to serve as a stop for spring 44 located in housing 40 to prevent overflexing of the spring during insertion of contact pin 45. In this particular embodiment, the spring 44 has a tab 44*a* bent at 90° so that in connection with ramp 46 and shoulder 48 a secure fastening is made between the spring and the housing.

Figure 9:
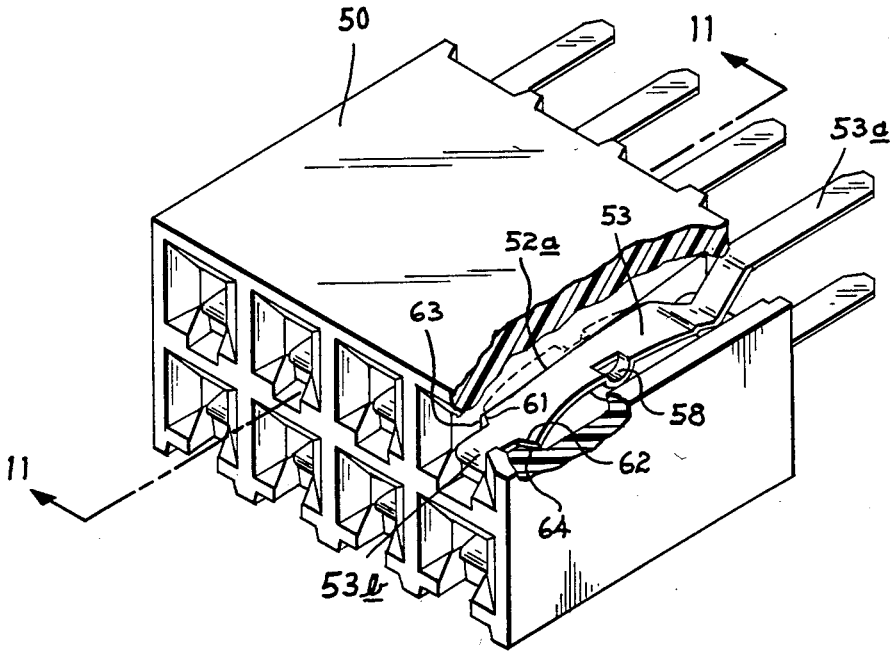
FIG. 9 is a perspective view of a preferred embodiment, partially in section.
Figure 10:
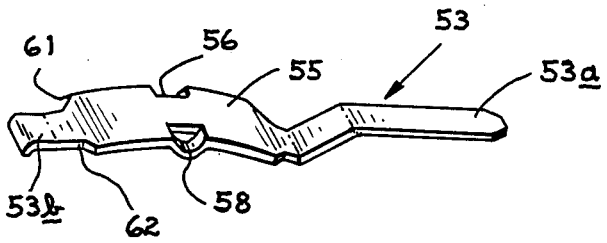
FIG. 10 is a perspective view of the leaf contact spring of FIG. 9.
Figure 11:
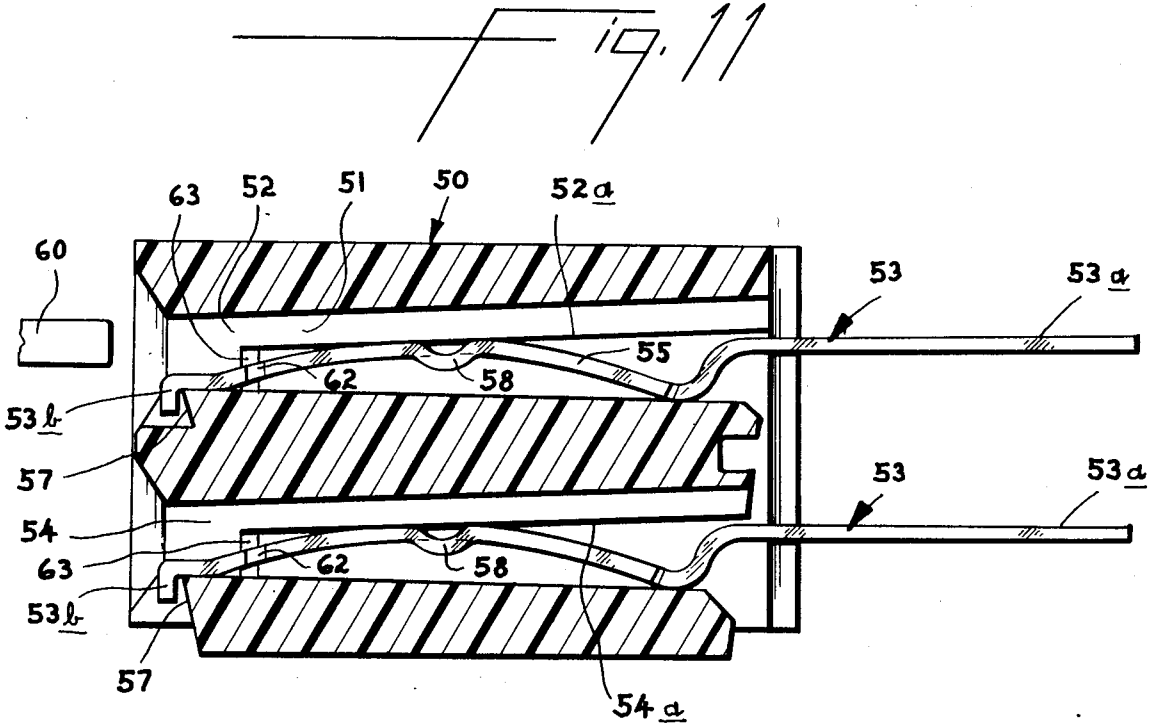
FIG. 11 is a cross-sectioned view of FIG. 9 taken along line 11—11.

In another preferred embodiment, shown in FIGS. 9–11, the housing 50 is made of insulating material and has a passage 51 there through which has sidewalls 52,54 defining inclined planes 52*a*, 54*a*. A metal leaf spring 53, has a central arc portion 55 which is formed with concave depressions 56,58 at each edge of the spring near the apex of the arc portion 55. The spring also has legs 53*a* formed at one end to provide for a solder connection. The terminal 53 is retained in the housing 50 by tab 53*b* engaged with lip 57 of the housing and shoulders 61,62 of the spring engaging angled stops 63,64 formed in the passage 52 of the housing. The inclined planes 52*a*,54*a* engage the edges of spring 53 and serve to preload the spring to reduce the insertion force of the pin 60 which is rectangular in cross-section. The side walls also serve as a guide for centering the pin 60 over the spring 53. The concave depressions 56,58 are rigid non-flexing portions that act as positive stops should the spring be overstressed by skewed insertion of pin 60 and assure that spring 53 can only be elastically deformed but not permanently deformed.

I claim:

1. An electrical receptacle comprising: a formed resilient metal leaf spring member received in a through passage defined by bottom, side and top walls in a plastic supporting housing, said through passage having an inclined portion in its top wall for contacting said spring member, said spring member being formed with an arc in its central portion, said arc having a nonflexing hump formed therein and flat length continuing therefrom that serves as a stop against the bottom wall of the passage; and means for securing said spring member in said through passage with its central arc portion contacting said inclined portion of the through passage in the receptacle to elastically deform the arc portion of the spring to preload the spring.

2. An electrical receptacle comprising: a formed resilient metal spring member received in a through passage in a plastic supporting housing, said through passage being defined by an inclined top portion and adjacent sidewalls tapering towards each other in a downwardly direction providing a width from top to bottom that exceeds the spring member width at the top of the passage and is less than the spring member width at a location below the top of the passage, said spring member being a leaf spring formed with an arc in its central portion; means for securing said spring in said passage with its central arc portion contacting said inclined portion of the through passage to elastically deform said arc portion of the spring to preload the spring, said sidewalls preventing permanent deformation of said spring.

3. An electrical receptacle comprising: a formed resilient metal spring member received in a through passage in a plastic supporting housing, said through passage having an entrance for a pin to enter the passage and engage the spring member and being defined by sidewalls defining planes at the top of the passage inclined toward said entrance, a stop located in at least one of the sidewalls extending into said passage near said entrance and a lip formed at the bottom edge of said entrance, said spring member being a leaf spring formed with an arc in its central portion, a concave depression near the apex of the arc in a direction opposed to the arc portion of the spring, a bent tab at one end and a shoulder located near said bent tab, said spring being secured in said passage by the simultaneous combination of said bent tab engaging said lip, said shoulder engaging said stop and said central arc contacting said inclined planes at the top of said passage to elastically deform said arc portion of the spring to preload the spring, said concave depressions being rigid non-flexing portions of the spring that serve as stops against the bottom of the passage to prevent overstressing the spring.

* * * * *